United States Patent [19]

Kajimaya et al.

[11] 4,190,516

[45] Feb. 26, 1980

[54] CATHODE

[75] Inventors: Yoshihisa Kajimaya; Takahide Kojima; Yoshio Murakami; Shunji Matsuura, all of Tokuyama, Japan

[73] Assignee: Tokuyama Soda Kabushiki Kaisha, Yamaguchi, Japan

[21] Appl. No.: 919,306

[22] Filed: Jun. 26, 1978

[30] Foreign Application Priority Data

Jun. 27, 1977 [JP] Japan ..... 52-75610

[51] Int. Cl.[2] ..... C25B 11/08; C25R 11/06

[52] U.S. Cl. ..... 204/290 R; 204/291

[58] Field of Search ..... 204/290 R, 291, 292; 427/123, 126

[56] References Cited

U.S. PATENT DOCUMENTS

| | | | |
|---|---|---|---|
| 3,282,808 | 11/1966 | Kander | 204/37 |
| 3,461,044 | 8/1969 | Lyons et al. | 204/3 |
| 3,607,411 | 9/1971 | Brownrigg | 429/242 |
| 3,632,498 | 1/1972 | Beer | 204/290 F |
| 3,649,485 | 3/1972 | Chisholm | 204/95 |
| 3,722,045 | 3/1973 | Buescher | 427/126 X |
| 3,877,987 | 4/1975 | Gutjahr et al. | 427/123 X |
| 3,947,333 | 3/1976 | Bianchi et al. | 204/129 |
| 3,974,058 | 8/1976 | Gokhale | 204/266 |
| 3,990,957 | 11/1976 | Hoekje et al. | 204/128 |
| 4,086,149 | 4/1978 | Martinson et al. | 204/59 R |

FOREIGN PATENT DOCUMENTS 51-54877 5/1976 Japan .

*Primary Examiner*—F. C. Edmundson

*Attorney, Agent, or Firm*—Wenderoth, Lind & Ponack

[57] ABSTRACT

A cathode consisting essentially of a base material of copper, iron or nickel and formed thereon, a sintered coating composed mainly of at least one metal of Group VIII of the periodic table, said sintered coating having been prepared by coating said base material with a solution or suspension of a compound of said metal of Group VIII and heating the coating.

11 Claims, 5 Drawing Figures

CATHODE

This invention relates to a new cathode for use in electrolysis, and specifically provides a cathode suitable for use in an electrolytic reaction involving the evolution of hydrogen at the cathode such as the electrolysis of water or an alkali metal salt.

Cathodes of this kind are required to possess resistance to the catholyte solution and to gases generated at the cathode, a low hydrogen overvoltage and high durability.

Iron or nickel is commonly used as a material for cathodes in the electrolysis of water or an aqueous solution of an alkali metal salt such as sodium chloride. While these materials are feasible as cathodes, it is desired to develop materials having still lower hydrogen overvoltages. The type of the cathodic material is not the only factor that determines the hydrogen overvoltage. It is known that the hydrogen overvoltage varies depending upon the surface condition of the cathodic material, and is greatly affected by the history of the material leading up to its formation as a cathode.

Various methods have therefore been suggested for obtaining cathodes of low hydrogen overvoltage. They include, for example, the sequential electrodeposition of copper and nickel thiocyanate on a titanium plate, the electrodeposition of an alloy of molybdenum or tungsten and a Group VIII metal on a titanium plate, and the sintering of an alloy of the two metals on a titanium plate.

The object of the present invention is to provide a cathode having a low hydrogen overvoltage and high durability at a commercially feasible cost.

The object of the invention is achieved by a cathode consisting essentially of a base material of copper, iron or nickel and formed thereon, a sintered coating composed mainly of at least one metal of Group VIII of the periodic table, said sintered coating having been prepared by coating said base material with a solution or suspension of a compound of said metal of Group VIII and heating the coating.

Some terms used herein are defined as follows:

The "metal of Group VIII of the periodic table" generically denotes at least one of Fe, Co, Ni, Ru, Rh, Pd, Os, Ir and Pt.

The "metallic substance", unless otherwise indicated, denotes a metal itself and a compound of the metal.

For the sake of convenience, the "solution or suspension of a metal compound" will be sometimes referred to generically as the "solution of the compound".

The "thickening agent" denotes a substance which is used to increase the viscosity of the solution and thus facilitate its adhesion and retention on the surface of a base material of copper, iron or nickel. The thickening agent includes, for example, polymeric substances such as methyl cellulose, polyvinyl alcohol and polyethylene oxide. Sometimes, the thickening agent serves concurrently as a suspending assistant and/or a suspension stabilizer.

By the expression "sintered coating composed mainly of a metal of Group VIII of the periodic table" is meant not only a coating converted to the metal by heat treatment of the metal compound but also a coating converted to another substance and a coating in which a metallic substance other than the metallic elements specified by the present invention is mixed in an amount less than one-half of the metal content.

The invention will now be described in accordance with the foregoing definitions.

The configuration of the cathode is not particularly restricted, and any currently known cathode configurations can be used without restriction. For example, the cathode may be in the form of a flat expanded metal, a perforated sheet, a wire netting, or an integrated structure composed of parallely arranged metal rods joined in part by ribs disposed at right angles to the rods.

Iron and nickel are especially recommended as the base material because these metals are generally corrosion-resistant to the catholyte solution under electrolytic conditions, possess relatively good conductivity and permit the formation of a firm sintered coating of the metallic substance specified by the present invention.

The coating metal compound must comprise at least one of Fe, Co, Ni, Ru, Rh, Pd, Os, Ir and Pt. For example, platinum, palladium, nickel, iron and other noble metals themselves are known to be usable as cathode materials. The use of these materials is shown, for example, in Japanese Laid-Open Patent Publications Nos. 54877/76 and 117181/76.

The present invention is not concerned merely with the use of noble metals as a cathode, but contemplates the effective utilization of special properties of the metallic coating determined by a method of its preparation, such as its adhesion with the base material, its apparent density, its interaction with other substances present together therewith, and its surface condition. This is clarified by FIGS. 1 to 4 accompanying this application.

Figure 1:
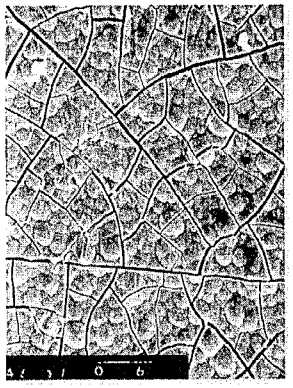
FIGS. 1 to 4 are photomicrographs of cathodes obtained by forming a coating of metal on an iron base material using nickel thiocyanate as the metallic compound.
Figure 2:
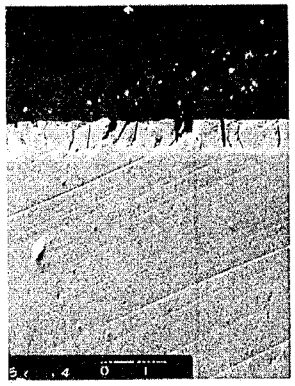
Figure 3:
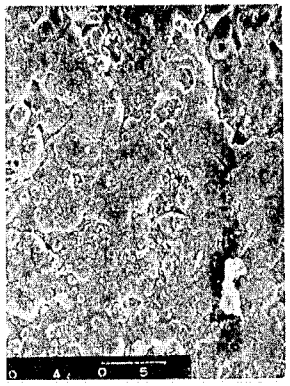
Figure 4:
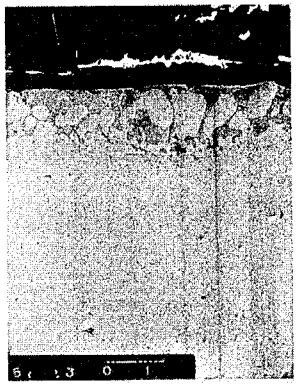

FIG. 1 shows a plated surface obtained by electroplating the base material at 60° C. for 30 minutes at a current density of 5 A/dm$^2$ using a bath containing nickel thiocyanate in a concentration of 120 g/l. FIG. 2 shows the cross-section of the plated product shown in FIG. 1. FIG. 3 shows the surface of a cathode material obtained by Example 1, Run No. 2 of the present application, and FIG. 4 is a cross-sectional view of FIG. 3. The magnification is 270× in FIGS. 1 and 3; 160× in FIG. 2; and 110× in FIG. 4.

A comparison of these photographs clearly shows that numerous cracks are observed in the electroplated surface (FIGS. 1 and 2), and the interface between the base material and the electroplated layer is distinct. On the other hand, the cathode in accordance with this invention (FIGS. 3 and 4) presents a surface of unique shape, and shows a considerable increase in surface area, and, furthermore, the interface between the base material and the coating is not distinct but they join each other moderately at the interface. This unique surface structure works effectively as a cathode.

The type of the compound of a metal chosen from Group VIII of the periodic table is not particularly restricted. The heat treatment should be carried out in such a manner that the metal compound will be decomposed to a metal by heating. If the compound is an oxide, this can be accomplished, for example, by using a reducing atmosphere. When the compound is, for example, an organo-metallic compound or a readily heat-decomposable compound, it can be heated in an inert atmosphere.

Some of the foregoing noble metals are difficult to oxidize with oxygen. In such a case, the metal compounds may be heated in the air. The important point is to ensure that an atmosphere and heat suitable for the formation of a coating of the metal should be provided in consideration of the type of the Group VIII metal and the condition of the metal compound. These conditions can be readily determined by those skilled in the art by performing preliminary tests.

Examples of the Group VIII metal compounds used in this invention include sulfides, thiocyanates, thiosulfates, sulfates, sulfites, thiocarbamates, xanthates and thiocarboxylates of these metals, and organic and inorganic sulfur-containing compounds of these metals which are relatively stable and do not substantially decompose at 100° C. or below in an inert atmosphere. Also effective are such inorganic compounds as nitrates, carbonates, phosphates, nitrites, oxides, cyanides and chlorides of the metals, and such organic compounds as acetates of the metals. Specific examples include iron compounds such as iron sulfide, iron sulfate, iron thiocyanate, iron thiosulfate, iron dithiocarboxylate, iron acetate, iron oxide and ferrocene; nickel compounds such as nickel sulfide, nickel sulfate, nickel thiocyanate, nickel dithiocarbamate, nickel xanthate, nickel nitrate, nickel oxalate and nickelocene; platinum compounds such as platinum cyanide, platinic acid, platinum hydroxide, platinum oxide, platinum sulfate and chloroplatinic acid; cobalt compounds such as cobalt aluminum oxide, cobalt acetate, cobalt ammonium chloride, cobalt carbonate, cobalt sulfide, cobalt iron oxide, cobalt phosphate, cobalt sulfate, cobalt yellow and cobalt oleate; ruthenium compounds such as ruthenium hydroxide, ruthenium oxide, ruthenium sulfide and ruthenium chloride; rhodium compounds such as rhodium nitrate, rhodium oxide, rhodium sulfide and rhodium sulfate; palladium compounds such as palladium sulfide, palladium carbonyl chloride, palladium oxide, palladium sulfate and palladium chloride; osmium sulfide; and iridium compounds such as iridium oxide, iridium sulfide; iridium carbonyl and iridium chloride. In addition to these compounds, other metals or metal compounds may be added in small quantities for filling purposes or in order to control the adhesion strength, surface condition, etc. of the coating.

It is generally preferred to treat the base material with an aqueous solution of phosphoric acid or its salt, especially manganese phosphate, zinc phosphate or iron phosphate, prior to use. In this case, the base material is pre-treated preferably by degreasing, washing with water, treatment with phosphoric acid or its salt, and then washing with water in this order. Sometimes, it is preferred to pretreat it with perchloric acid in a customary manner.

At least one Group VIII metal compound is dissolved or suspended in water or another medium and coated on the base metal. The viscosity of the solution becomes an important factor in this case. For example, a solution obtained by merely dissolving or suspending the metal compound in water usually has a low viscosity and cannot be applied uniformly to the base material. Moreover, it is difficult to retain a required amount of the coated solution on the base material.

To avoid this inconvenience, the use of a thickener is usually recommended. Examples of the thickener are organic polymeric substances such as polyvinyl alcohol, methyl cellulose, polyacrylic acid, starch, gelatin and polyethylene glycol, and inorganic polymeric substances such as polyphosphoric acid or its salts and water glass. To stabilize the suspension, various surfactants and alcohols such as methanol (assistants) may be added. Usually, the solution preferably has a viscosity of about 50 to about 1,500 centipoises.

The method of coating is not particularly critical. The simplest procedure consists of merely dipping the base material in the solution and withdrawing it from the solution. Brush coating and spray coating can also be used. It is also effective to repeat a coating-drying procedure a plurality of times. The base coated with the solution is dried and then heat-treated. The heating should be carried out under conditions which cause the conversion of the compound of the Group VIII metal predominantly to the metal. Usually, it is recommended that the heat-treatment be effected at a temperature of 400° to 1,200° C., especially 500° to 1,100° C., in a non-oxidizing atmosphere, for a period of usually 30 minutes to several hours, preferably about 1 to 2 hours.

By performing the above cycle of the coating step, the drying step and the heat-treatment step a plurality of times, for example about 5 to 100 times, a tough thick coating can be formed.

The suitable thickness of the sintered coating changes depending upon the type of the Group VIII metal, and it is convenient to change the concentration of the metal compound in the coating solution or suspension to be applied to the base metal according to the type of the metal of Group VIII. Generally, when the Group VIII metal is Fe, Co or Ni, the thickness of the sintered coating is preferably 10 to 1,000 microns, and the concentration of the metal compound in the solution or suspension is preferably 0.5 to 60% by weight calculated as metal. If, on the other hand, the Group VIII metal is Ru, Rh, Pd, Os, Ir or Pt, the thickness of the sintered coating is preferably 0.1 to 10 microns, and the concentration of the metal compound in the solution or suspension is preferably 0.1 to 10% by weight calculated as metal.

A cathode obtained in this manner has a hydrogen overvoltage, as measured in an 80° C. aqueous alkali solution at 30 A/dm$^2$, of at least about 50 mV, and generally 100 to 200 mV, which is lower than a cathode consisting of either the base material alone or a Group VIII metal having resistance to the electrolyte solution.

The effect of a sulfur-containing compound used as the metal compound is noteworthy in the present invention. When a sulfur-containing metal compound is used in this invention, sulfur element remains in the coating although its form is unknown. The content of elemental sulfur affects the hydrogen overvoltage of the resulting cathode.

Figure 5:
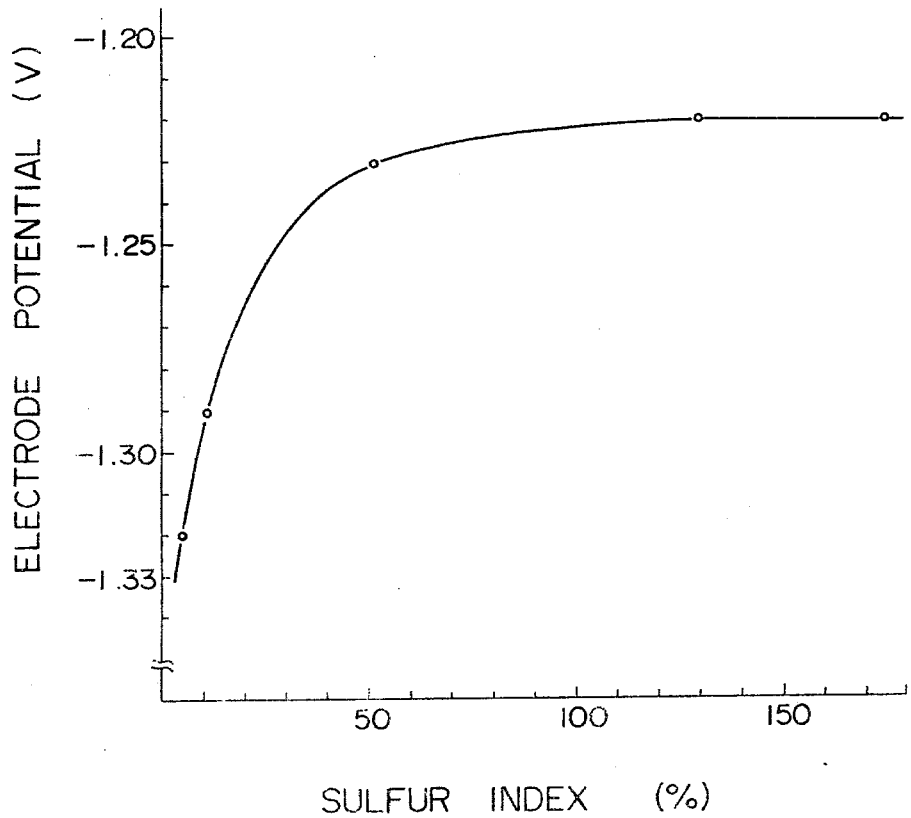
FIG. 5 is a graph of the relation between electrode potential and sulfur index.

In order to show the relation between the hydrogen overvoltage and the content of sulfur more clearly, the hydrogen overvoltage and the content of sulfur expressed as a sulfur index based on the sulfur content of a sample obtained by the method indicated below are plotted in FIG. 5. FIG. 5 refers to the use of nickel thiocyanate with the sulfur content varied according to the heating time and temperature. As shown in FIG. 5, if the sulfur index is at least about 5%, the cathode potential increases with increasing sulfur content, and approaches a constant value when the sulfur index exceeds about 50%. In accordance with the present invention, the sulfur index may be at least 3%.

The sulfur index, as used herein, is measured in the following manner. A plating bath containing 120 g/liter of nickel thiocyanate is used, and is electrodeposited on a base material for 30 minutes at 60° C. and a current density of 5 A/dm$^2$ with stirring. The sulfur content of the resulting sample is determined by fluorescent X-rays. The sulfur content thus determined is taken as 100, and the sulfur content of each sample is expressed as the percentage.

Specifically, the fluorometric analysis is performed in the following manner. First, the sample is placed in a stainless steel sample holder (50 mm in diameter and 50 mm in height). It is then covered with an aluminum mask provided with a hole of 10 mm diameter and the sample is fluorometrically analyzed. The analytic instrument used in the Examples of this application is a Geiger-Flexfluorescent X-ray device manufactured by Rigaku Denki Kogyo Co., Ltd. A Cr tube and a Ge spectral crystal are used, and the sulfur K$\alpha$ ray and PC2$\ominus$=110.67° were measured at a current and voltage of 32.5 KV-20 mA at count full scale of $4\times10^3$, a scanning speed of 4°/min. and a chart speed of 20 mm/min. to record the height of peaks, which are then compared.

EXAMPLE 1

Each of the compounds shown in Table 1 (40 to 80 parts) was mixed with 2 parts of methyl cellulose, 2 parts of polyethylene glycol and 70 parts of water to form a viscous suspension having a viscosity of about 500 centipoises. The suspension was brush-coated on a mild steel rod having a diameter of 16 mm and a length of 50 mm. The coated rod was heat-treated in a nitrogen atmosphere in an electric furnace at 800° to 1100° C. for 1 to 4 hours. The results are shown in Table 1.

Table 1

| Run No. | Group VIII metal compound | Heating conditions: Temperature (°C.) | Heating conditions: Time (hr) | Cathode potenial (V)*: Initial | Cathode potenial (V)*: Two months later |
|---|---|---|---|---|---|
| 1 | Fe rod | not heated | — | −1.50 | −1.52 |
| 2 | $Ni(SCN)_2$ | 900 | 1 | −1.23 | −1.24 |
| 3 | NiS | 1100 | " | −1.22 | −1.23 |
| 4 | $NiSO_4$ | 1100 | " | −1.26 | −1.27 |
| 5 | FeS | 900 | " | −1.26 | −1.27 |
| 6 | $K_3[Fe(CN)_6]$ | " | " | −1.29 | −1.30 |
| 7 | $Fe(SCN)_3$ | 1100 | " | −1.26 | −1.28 |
| 8 | $Fe_2(SO_4)_3$ | " | | −1.27 | −1.28 |
| 9** | $Fe_2O_3$ | | | −1.20 | −1.35 |
| 10 | $Ni[S_2CN(C_2H_5)]_2$ | 900 | " | −1.27 | −1.30 |
| 11 | $Ni(S_2COC_2H_5)_2$ | " | " | −1.26 | −1.27 |
| 12 | $Ni(O_2CCH_3)_2$ | 800 | " | −1.29 | −1.32 |
| 13 | $Ni(C_5H_5)_2$ | " | " | −1.30 | −1.33 |
| 14 | $Fe(O_4C_2)$ | " | " | −1.30 | −1.32 |
| 15 | $Fe(O_2CCH_3)_3$ | 900 | " | −1.30 | −1.33 |
| 16 | $Fe(C_5H_5)_2$ | 800 | " | −1.31 | −1.34 |

*A 1-liter polytetrafluoroethylene beaker was charged with 850 ml of a 20% aqueous solution of sodium hydroxide, and each of the samples was placed in it as a cathode, and a platinum plate with a surface area of 30 cm$^2$ was used as the anode. A direct current of 50 A/dm$^2$ was passed using a rectifier, and the cathode potential was measured. The cathode potential was measured in a customary manner by the Luggin Capillary Method by using a mercury oxide electrode as a reference. The temperature of the solution in the beaker was maintained at 80° C. ± 2° C. with a constant temperature tank, and the solution was replaced with a new one every 2 days.

**In Run No. 9, the heat-treatment was performed in a hydrogen atmosphere.

EXAMPLE 2

A suspension having a viscosity of about 500 centipoises and consisting of 40 parts of nickel thiocyanate, 1.5 parts of methyl cellulose, 1.5 parts of polyethylene glycol and 30 parts of water was coated on the same base material as used in Example 1, and then heat-treated at 1100° C. for 1 to 12 hours. The initial cathode potential was measured in the same way as in Example 1. The results are shown in Table 2 and also graphically in FIG. 5.

Table 2

| Run No. | Temperature (°C.) | Time (hr) | Sulfur index (%) | Initial cathode potential (V) |
|---|---|---|---|---|
| 1 | 1100 | 1 | 175 | −1.22 |
| 2 | 1100 | 1 ⅔ | 130 | −1.22 |
| 3 | 1100 | 4 ½ | 52 | −1.23 |
| 4 | 1100 | 9 ⅓ | 11 | −1.29 |
| 5 | 1100 | 12 | 5 | −1.32 |

EXAMPLE 3

A viscous solution having a viscosity of about 350 centipoises and consisting of 40 parts of each of the Group VIII metal compounds shown in Table 3, 1 part of methyl cellulose, 1 part of polyethylene glycol and 100 parts of water was coated on a nickel plate with a size of 10 mm×30 mm, and then heated at 900° C. for 1 hour in an argon gas atmosphere. The cathode potential was measured in the same way as in Example 1. The initial potentials and the potentials measured two months later are shown in Table 3.

Table 3

| Run No. | Group VIII metal compound | Cathode potential (volts): Initial | Cathode potential (volts): Two months later |
|---|---|---|---|
| 1 | $Na_2(PtCl_4)$ | −1.26 | −1.30 |
| 2 | $(NH_4)CoCl_3$ | −1.28 | −1.30 |
| 3 | $RuCl_4$ | −1.28 | −1.29 |
| 4 | $Pd(NO_3)_2$ | −1.29 | −1.30 |
| 5 | $KRh(SO_4)_2$ | −1.23 | −1.24 |
| 6 | $OsS_4$ | −1.24 | −1.25 |
| 7 | $OsCl_3$ | −1.29 | −1.30 |
| 8 | $IrS_2$ | −1.24 | −1.25 |
| 9 | $PtCl_4$ | −1.26 | −1.26 |
| 10 | CoS | −1.23 | −1.23 |

EXAMPLE 4

Two solutions each having a viscosity of about 500 centipoises were prepared by adding 40 parts of nickel sulfide and 40 parts of iron sulfide respectively to a mixture of 1.5 parts of methyl cellulose, 1.5 parts of polyethylene glycol, 60 parts of water and 40 parts of methanol. A copper rod having a length of 50 mm and a diameter of about 20 mm was immersed in each of these solutions, withdrawn, dried, and heat-treated at 900° C. for one hour. These rods were used as cathodes, and the cathode potentials were measured in the same way as in Example 1. The results were as follows:

Nickel sulfide: −1.17 (initial), −1.19 (two months later)

Iron sulfide: −1.19 (initial), −1.20 (two months later).

EXAMPLE 5

An iron plate (SS41) having a size of 10 mm×30 mm was polished with emery paper, washed with water, immersed in 10% hydrochloric acid, and then immersed at 60° C. for 10 minutes in a treating agent consisting of a 3% aqueous solution containing 60 g of $H_3PO_4$, 10 g of $Zn_3(PO_4)_2.4H_2O$ and 10 g of $NaH_2PO_4.2H_2O$. A suspension having a viscosity of about 100 centipoises and consisting of 40 parts of nickel thiocyanate, 1.5 parts of methyl cellulose, 1.5 parts of polyethylene glycol and 500 parts of water was coated on the pre-treated base material, and heat-treated in an inert atmosphere at 900° C. for 1 hour. This coating-heat-treating cycle was repeated five times to produce a cathode.

The cathode potential of this cathode, measured in the same way as in Example 1, was −1.21 volts at the initial stage, and −1.22 volts after a lapse of four months.

EXAMPLE 6

A mild steel expand metal having a size of 10 cm×10 cm was immersed for 1 hour in a 40% aqueous solution of perchloric acid at 50° to 60° C., washed with water, and dried. A solution having a viscosity of about 50 centipoises and containing 1 g of iridium chloride ($IrCl_4$), 80 ml of butanol and 1 ml of 12 N hydrochloric acid was coated on the pre-treated base material, dried, and heat-treated in a nitrogen atmosphere at 450° C. for 1 hour. This coating-heat-treating cycle was repeated ten times to make a cathode.

The cathode potential of this cathode, measured in the same way as in Example 1, was −1.12 volts at the initial stage and −1.15 volts after a lapse of four months.

What we claim is:

1. A cathode consisting essentially of a base material of copper, iron or nickel and formed thereon, a sintered coating composed mainly of at least one metal of Group VIII of the periodic table, said sintered coating having been prepared by (1) coating said base material with a solution or suspension of at least one sulfur-containing compound of said metal of Group VIII, which sulfur-containing metal compounds are capable of being predominantly converted to a metal by sintering said compounds, and (2) heating the coating, said sintered coating containing at least 3% of sulfur in terms of the sulfur index as defined in the specification.

2. The cathode of claim 1 wherein said solution or suspension further includes a suspending aid or a suspension stabilizer.

3. The cathode of claim 1 wherein the metal compound is a sulfur containing nickel compound, or a sulfur containing iron compound, or both.

4. The cathode of claim 3 wherein the nickel compound is at least one member selected from the group consisting of nickel dithiocarboxylate, nickel dithiocarbamate and nickel xanthate.

5. The cathode of claim 3 wherein the nickel compound is at least one member selected from the group consisting of nickel thiocyanate, nickel sulfide, nickel thiosulfate, nickel sulfate and nickel sulfite.

6. The cathode of claim 1 wherein the metal compound is a sulfur containing inorganic metal compound.

7. The cathode of claim 1 wherein the metal compound is a sulfur containing organic metal compound.

8. The cathode of claim 1 wherein the metal compound is at least one sulfur-containing compound selected from the group consisting of a sulfur-containing platinum compound, a sulfur-containing iridium compound and a sulfur-containing palladium compound.

9. The cathode of claim 1 wherein the metal compound is at least one sulfur-containing compound selected from the group consisting of a sulfur-containing ruthenium compound, a sulfur-containing osmium compound and a sulfur-containing rhodium compound.

10. The cathode of claim 1 wherein the solution or suspension contains a polymeric substance selected from the group consisting of polyvinyl alcohol, methyl cellulose, polyacrylic acid, starch, gelatin, polyethylene glycol, polyethylene oxide, polyphosphoric acid, a salt of polyphosphoric acid and water glass.

11. The cathode of claim 1 wherein the solution or suspension has a viscosity of from about 50 to about 1500 centipoises.

* * * * *